US007195443B2

(12) United States Patent
Vandervort et al.

(10) Patent No.: US 7,195,443 B2
(45) Date of Patent: Mar. 27, 2007

(54) VARIABLE PRESSURE-CONTROLLED COOLING SCHEME AND THRUST CONTROL ARRANGEMENTS FOR A STEAM TURBINE

(75) Inventors: Christian Lee Vandervort, Voorheesville, NY (US); Je-Hoon Kim, Seoul (KR)

(73) Assignee: General Electric Company, Schenectady, NY (US)

( * ) Notice: Subject to any disclaimer, the term of this patent is extended or adjusted under 35 U.S.C. 154(b) by 200 days.

(21) Appl. No.: 10/905,307

(22) Filed: Dec. 27, 2004

(65) Prior Publication Data

US 2006/0140747 A1 Jun. 29, 2006

(51) Int. Cl.
*F01D 3/04* (2006.01)

(52) U.S. Cl. ..... 415/1; 415/26; 415/151; 415/107

(58) Field of Classification Search ..... 415/104, 415/105, 107, 112, 1, 151, 26; 60/679
See application file for complete search history.

(56) References Cited

U.S. PATENT DOCUMENTS 6,705,086 B1 * 3/2004 Retzlaff et al. ..... 60/653
6,892,540 B1 * 5/2005 Tisenchek ..... 60/645
6,957,945 B2 * 10/2005 Tong et al. ..... 415/1

OTHER PUBLICATIONS

Heinz P. Bluch; A Practical Guide to Steam Turbine Technology; 1996; pp. 30, 31, 48, 57, 218.
K. C. Cotton; Evaluating and Improving Steam Turbine Performance; 1993; pp. 36, 71, 211.

* cited by examiner

*Primary Examiner*—Ninh H. Nguyen
(74) *Attorney, Agent, or Firm*—Cantor Colburn LLP

(57) ABSTRACT

A method and system for actively controlling thrust pressure in a steam turbine is disclosed. The method may comprise monitoring a thrust pressure affecting a thrust fitting in a steam turbine, and adjusting the thrust pressure to maintain a desired thrust pressure on the thrust fitting in the steam turbine.

16 Claims, 4 Drawing Sheets

VARIABLE PRESSURE-CONTROLLED COOLING SCHEME AND THRUST CONTROL ARRANGEMENTS FOR A STEAM TURBINE

BACKGROUND OF THE INVENTION

Steam turbines have been commonly applied to generation of mechanical or electrical power for over one hundred years. The standard cycle is based upon a source of heat energy to generate steam, a turbine, a water or air cooled condenser for heat rejection, and a pumping system. Steam turbines are highly efficient as the expansive force of steam is the greatest of any of the common gases used for powering turbines. Steam turbines also benefit from use of an inexpensive, plentiful, and environmentally friendly working fluid. Thus, steam turbines are used in many applications.

However, achievement of the highest possible efficiencies requires that high temperatures and high pressures be utilized. In turn, robust operation of steam turbines under these conditions can be problematic. For example, inlet temperatures and pressures of 1400 degrees Fahrenheit (760° C.) and 5600 psi have been used. Common conditions for a modern boiler and steam turbine system are approximately 1050 F. (565 C.) and 2400 psi. This type of system would normally incorporate "reheat" wherein the steam reenters the boiler for one or more stages of heat addition.

Typically, the first turbine section downstream of the boiler and up-stream of the first reheat is referred to as the high pressure (HP) turbine. Exhaust steam from the high pressure (HP) turbine is sent to the boiler for reheating along a cold reheat line. The reheated steam is typically heated to the initial inlet temperature before flowing into an intermediate pressure (IP) turbine. Exhaust from the IP turbine enters and flows through the low pressure (LP) turbine prior to exhaust to the condenser. Some systems may not incorporate the IP section, and more complex systems may have multiple reheat stages. Physical design of the system can vary dependent upon the application. Turbine sections can reside within the same casing, or multiple casings may exist.

A main output shaft, and an area proximate to the spinning steam turbine rotor, typically include bearings designed to handle high temperatures and high pressures. These bearings normally include internal oil seals located between the bearing and the output shaft. In addition, a "thrust" bearing is required to absorb the axial load developed by the power train. This bearing is held in place, or held in a limited range of movement, by axial thrust force and by hydraulic force of the oil in the bearing. This thrust force is created through a combination of the fluid inertia on the turbine buckets and the pressure developed by variation in cross-sectional area activated by using excess steam from the overall system. As the respective bearings may only withstand certain temperatures and pressures of steam, the thrust pressure applied and resultant from the steam, must be within permissible temperature and pressure parameters. Thus, suitable temperature cooling steam from the system may be used to cool areas of the turbine and to provide pressure.

An additional consideration associated with thrust bearings is that thrust bearings do not readily accept multiple and repeated directional changes in thrust due to the existence of a near-zero thrust region wherein the bearing may become metastable. This relationship is shown in FIG. 3. In other words, thrust bearings are designed to be pressurized in a stable manner from one direction or the other. Their ability to rapidly absorb directional reversals in thrust is limited. It is noted herein that substantial damages may occur when steam turbine bearings fail.

Therefore, it is a challenge to ensure that only acceptable pressures and temperatures of steam, including cooling steam, are present in appropriate parts of the system. In response, in the art, turbines and their associated bearings are typically designed and optimized from the outset for a specific set of conditions. For example, a certain size and thrust load capability of a bearing is specified and safety margins are specified by design. However, due to anomalies and also due to standard differences in operating conditions, the reliability of modern steam turbines can still be improved, i.e., start-up verses steady state, failure of the oil seals upon exposure to temperatures beyond design limits, extreme steam temperatures and pressures, vibration, bearing wear, and due to manufacturing variations and other anomalous conditions. It is necessary to ensure that all turbines manufactured achieve their operational and reliability requirements. A single variation from this requirement can be commercially consequential to a steam turbine manufacturer.

Thus in summary, prior art strategies typically attempt to accommodate anomalies and changes in temperature, pressure, and thrust load on a bearing, such as a thrust bearing, by specifying a large or oversized thrust bearing or by compromising on other design goals such as system efficiency or lowest achievable cost. The amount of steam pressure on the bearing or in the various stages of the turbine is typically chosen as a fixed parameter by original design, and is set up for expected conditions including steam cooling requirements. This may be thought of as a passive pressure control strategy and system. Thus, an active pressure and/or thrust control system for a steam turbine is needed.

BRIEF DESCRIPTION OF THE INVENTION

A method and system for actively controlling thrust pressure in a steam turbine is disclosed. The method may comprise monitoring a thrust pressure affecting a thrust fitting in a steam turbine, and adjusting the thrust pressure to maintain a desired thrust pressure on the thrust fitting in the steam turbine.

BRIEF DESCRIPTION OF THE DRAWINGS

The following descriptions are not intended to be, and should not be considered to be, limiting in any way.

DETAILED DESCRIPTION OF THE INVENTION

The present embodiment may include an active pressure barrier and thrust control system for a steam turbine and may be embodied as a physical control layer comprising arrangements of secondary piping and valves. This active control layer is suitable for use in a steam turbine having underlying primary steam turbine structures or sections which are well known. Thus, the entire structure of a known steam turbine subject to control by the present control system is not shown. It is noted herein that the control system is not limited to control of one particular type of steam turbine.

To illustrate this embodiment, a multi-stage steam turbine is used as the underlying turbine to be controlled. However, the concepts of the present invention would also be applicable to single stage steam turbines; thus, the underlying steam turbine structure should not be considered as limiting to the active control concepts described herein.

Figure 1:
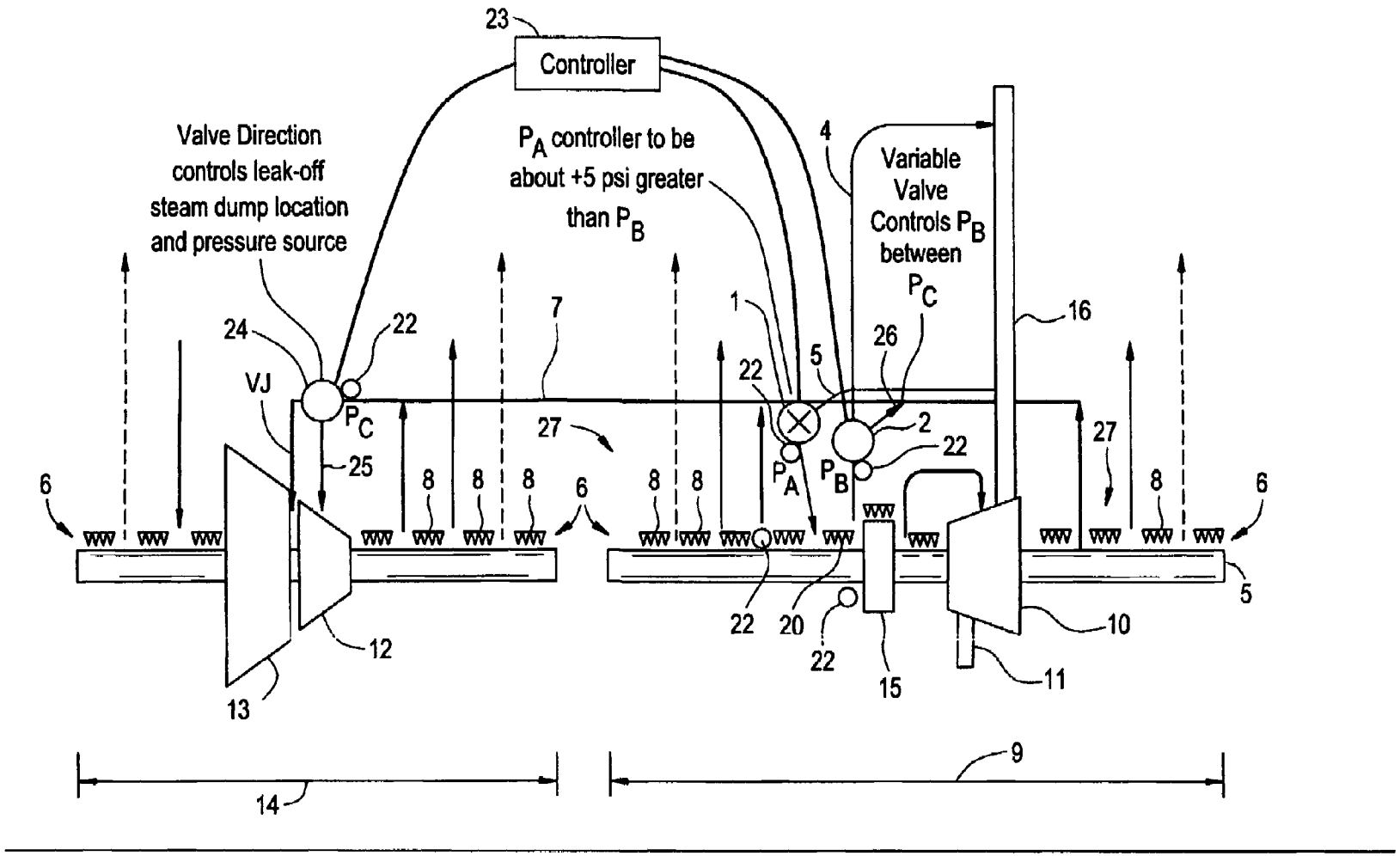
FIG. 1 is a side view of a steam turbine system in accordance with an exemplary embodiment.

In multistage steam turbines, multiple "stages" of turbine wheels or rotors with vanes are mounted on the same shaft. The steam passes through the various turbine wheels. For example, steam may first drive a turbine in a high pressure stage, and typically after a reheat, it may be sent to an intermediate pressure stage, and then to a low pressure stage as it loses pressure from stage to stage. The embodiment described below and shown in FIG. 1 is based upon a configuration with a distinct HP section 9 within its own casing, and a combined IP and LP section 14 wherein each section resides in the same casing. Each of these sections reside on a common shaft 5 that may be coupled to a generator for electric power generation or to a mechanical load.

Figure 2:
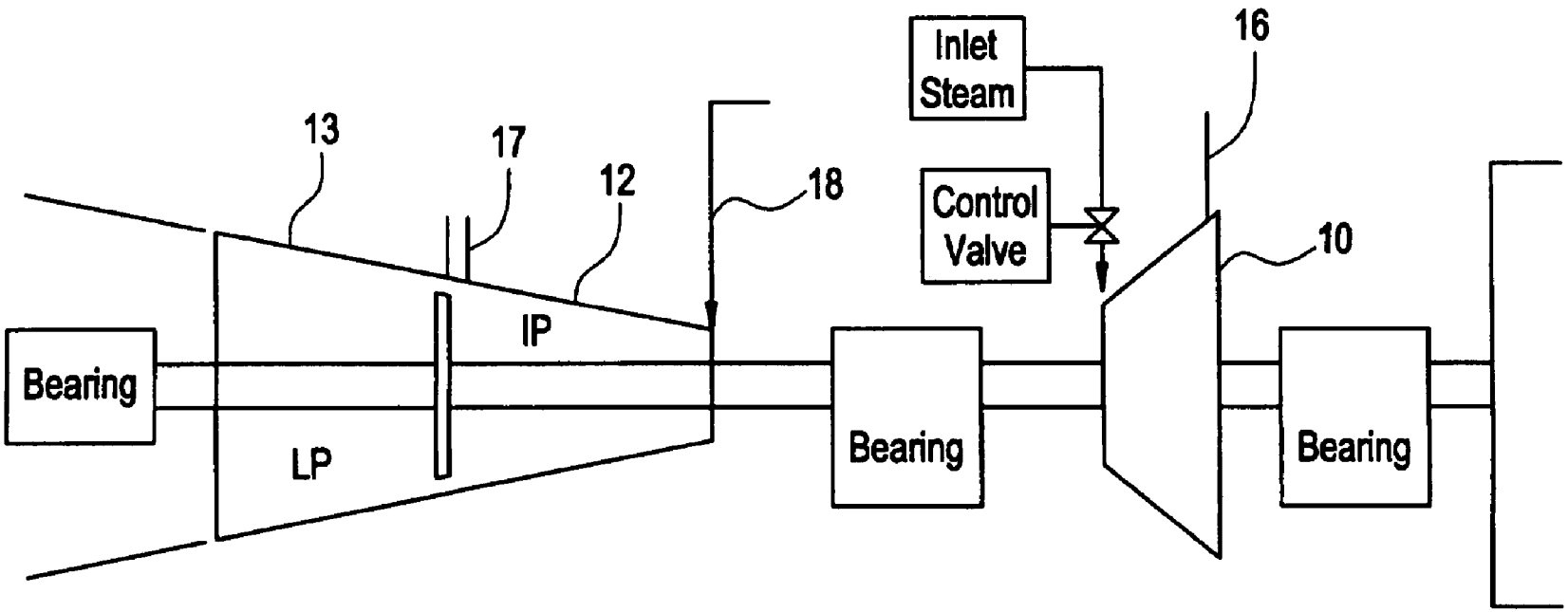
FIG. 2 is a side view of a steam turbine system in accordance with an exemplary embodiment.

For example in FIGS. 1 and 2, FIG. 1 shows the secondary layer of control piping and FIG. 2 shows the underlying multistage structure. A high pressure (HP) stage 10 is shown connected to a boiler piping 11 which is connected to a boiler (not shown). The high pressure stage 10 receives steam from the boiler at high temperatures and pressures. Steam flows through the turbine (not shown) in the high pressure (HP) stage 10 and then exits to return to the boiler for reheating at a HP exhaust pipe 16. Once reheated, the reheated steam is subsequently directed to the Intermediate Pressure (IP) stage 12 via IP reheat pipe 18 and then to Low Pressure (LP) stage 13 via (LP) reheat pipe 18 as shown generally in FIG. 2. In FIG. 1, a high pressure casing 9 is shown on the right and an intermediate pressure/low pressure (IP/LP) casing 14 is shown on the left. Cooling steam shown as arrows 6 is propagated axially along the shafts through seals such as labyrinth seals 8 as is well known.

Figure 4:
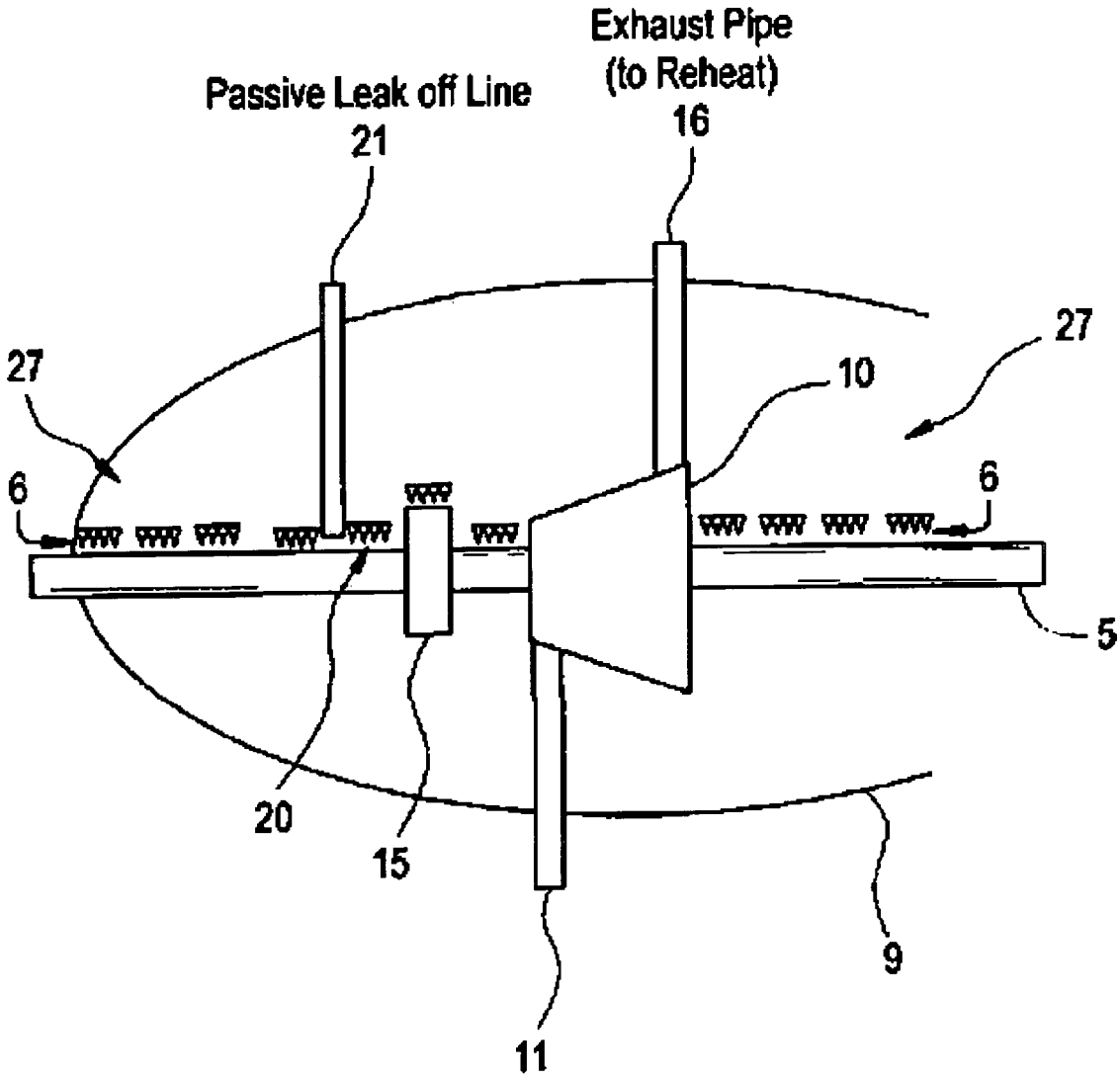
FIG. 4 PRIOR ART
FIG. 4 is a side view showing a prior art arrangement.

In FIG. 1, an axially displaceable thrust piston 15 is included in the high pressure casing 9. A thrust piston 15 may be used for example in steam turbines to help compensate for differences between the inlet and outlet pressures. Additionally a skimmer 20 is located to the left of the thrust piston 15. The prior art as shown in FIG. 4 may typically include a passive "leak-off" line 21 or extraction pipe placed to the immediate left of the skimmer. The purpose of the leak-off line 21 is to attempt to extract any high temperature steam that enters the HP stage, moves left towards the thrust piston and over the outer section of the thrust piston, and then moves past the skimmer so that it cannot continue to move left. This may be considered a "passive" system because the leak off line 21 flow cannot be actively controlled or adjusted because of the fixed source pressure, i.e., the structure is set at the time of the manufacture with virtually no control over excessive-wear induced issues as mentioned in the Background section above.

In contrast, in the embodiment as shown in FIG. 1, a controllable first pressure tap 1, may be placed immediately to the left of the skimmer 20. Additionally, a second controllable pressure tap 2 may be placed between the right-hand side of the skimmer 20 and to the left hand side of the thrust piston 15. These pressure taps (1,2) are connected to the secondary layer of active control pipes.

For example, in an embodiment, if sensor 22 sends a feedback signal from the thrust piston 15 area that indicates that there is a need for thrust control, the controller 23 may control the system to respond as follows. The second pressure tap 2 which may be a pressure/flow control valve will start controlling its valve openings to obtain the desired pressure on one side of the thrust bearing 15 to increase or decrease thrust. Simultaneously, the first pressure tap 1, which may be a pressure control valve, will be adjusted along with the second tap 2, thereby maintaining a slightly higher (positive) pressure at the area connected to the second pressure tap 2. Both taps (1,2) may be controlled to match the lowest possible pressure needed to exactly match the amount of required thrust and sealing and cooling steam 6.

Specifically, as shown in FIG. 1, first pressure tap 1 is connected to input control line 3 which is connected to the HP exhaust pipe 16 or "cold reheat." Second pressure tap 2 is connected to output control line 4 which outputs to HP exhaust pipe 16. Pressure tap 1 is also connected to IP/LP control line 7 running between the high pressure casing 9 and the IP/LP casing 14. Two additional lines, IP line 25 and P/F valve line 26, are included as shown in FIG. 1. The P/F valve line 26 is connected to the LP/IP control line 7. A third valve, IP/LP pressure control valve 24 is also included in LP/IP control line 7 as shown in FIG. 1.

Three pressures $P_A$, $P_B$, and $P_C$ will be controlled as shown in FIG. 1. The main role of the IP/LP pressure control valve 24 is to select upon direction from a controller 23 an appropriate intermediate or low pressure source $P_C$ to provide the control system enough of a pressure control margin to $P_B$ which is the pressure at the thrust control location relative to the thrust piston 15. Given the arrangement, by selecting different source pressure ($P_C$ or cold reheat pressure) and further controlling resulting $P_B$ pressure via valve opening via second pressure tap 2 for example, it is now possible to have a range of available $P_B$ pressure, which allows sufficient control of thrust by creating a variable pressure difference around the thrust piston 15. $P_A$ pressure should be controlled simultaneously, and should be typically maintained slightly higher, for example about 5 psi higher than $P_B$ to minimize leak-off steam while controlling thrust. This forms the aforementioned positive pressure barrier around the skimmer 20 in FIG. 1, and will prevent potentially dangerous hot leak-off steam from traveling to the left side of the thrust piston 15 at all times.

Pressure sensors 22 may be located where appropriate. For example, sensors may typically be included near the first pressure tap 1 and second pressure tap 2, and near the thrust piston 15 as appropriate. A controller 23 reads the output from the pressure sensors 22 and provides active control of the first pressure tap 1 and second pressure tap 2. For example, this active control system and method may create a +5 psi pressure barrier near the skimmer 20 wherein the cooling steam will flow from left to right over the skimmer 20 and into the output control line 4 piping connected to second pressure tap 2 which may be routed back to the boiler for reheating. In other words, an actively controllable pressure and thrust barrier is formed because first pressure tap 1 is controlled to be about 5 psi greater in pressure than second pressure tap 2. Thus, high temperature steam from the High pressure stage(HP) 10 is actively prevented from proceeding to the left and over the skimmer. Thus, changes in operating conditions during start up for example, as well as anomalies and axial thrust changes in general, do not disable this active system. Thus, this active system actively protects the skimmer and any other proximate bearings or seals from being exposed to damaging HP steam incident from the High Pressure Stage (10).

Additionally, due to the nature of rotor dynamics, packing seals located on the thrust or balance piston 15 are the most likely to wear or "rub-off" first and often in a severe manner.

Thus, this type of arrangement is often accompanied by the skimmer 20, which is typically a small number of HiLo teeth located next to a thrust packing. As the name suggests, the purpose of a skimmer is to divert or "skim off" hot leak-off steam to reusable sources in a steam turbine rather than just passing hot steam to the next packing rings. The present invention realizes that when both skimmer 20 and thrust packing seal(s) open up much more than design intent, dangerously high temperature conditions are highly likely to occur, for example, a 100° F. increase may occur near a bearing area. This is because high temperature steam can flow under the skimmer tooth and can be passed onto the next neighboring packings. Thus, the present active pressure and control system solves this problem with an active control system of a thrust fitting which may be a thrust piston or thrust bearing for example.

For example, in an embodiment, if sensor 22 sends a feedback signal from the thrust piston 15 area that indicates that there is a need for thrust control, the controller 23 may control the system to respond as follows. The second pressure tap 2 which may be a pressure/flow control valve will start controlling its valve openings to obtain the desired pressure on one side of the thrust bearing 15 to increase or decrease thrust.

Simultaneously, the first pressure tap 1, which may be a pressure control valve, will be adjusted along with the second tap 2, thereby maintaining a slightly higher (positive) pressure at the area connected to the second pressure tap 2. Both taps (1,2) may be controlled to match the lowest possible pressure needed to exactly match the amount of required sealing and cooling steam 6. For example, the following control routine shown in Table 1 may be implemented depending upon the state of the turbine, start-up, steady-state, or additional thrust control needed.

TABLE 1

| Mode | Situation | Bypass valve 24 ($P_C$)open for | Pressure/ flow control valve 2 ($P_B$)open for | Pressure control valve 1 ($P_A$) | Goals other than thrust control and positive P barrier/ remarks | Controllable P at ($P_A$) | Controllable P at ($P_B$) |
|---|---|---|---|---|---|---|---|
| Design condition | Steady State Full Load, no need for additional thrust | LP VJ (or IP L-2 if it offers better sealing performance) | Line 4 (Cold reheat P) as intended | Fully open. +5 psi higher P than $P_B$ maintained by design. Adjust opening as needed. | Self-sealing point control | 95~530(but should allow minimum steam required for steam seal, not zero flow) | 90~525(but should allow minimum steam required for steam seal, not zero flow) |
| Control Mode 1 | Additional thrust needed for steady state operation | LP VJ or IP L-2 | Line 7 (P at LP VJ or IP L-2) | Valve opening controlled, Maintain +5 psi ligher P than $P_B$ | Emergency situation caused by potential design defects | 95~530(but should allow minimum steam required for steam seal, not zero) | 90~525(but should allow minimum steam required for steam seal, not zero) |
| Control Mode 2 | Additional thrust needed during startup | LP VJ or IP L-2 depending on the thrust condition. | Line 7 or Line 4 depending on the thrust condition. | Valve opening controlled. Maintain +5 psi higher P than $P_B$ | Cover temporary thrust variation, Prevent differential thermal expansion in steam turbine shell | 95 (depends on startup method)~530(but should allow minimum steam required or steam seal, not zero) | 90 (depends on startup method)~525(but should allow minimum steam required or steam seal, not zero) |

VJ = Vertical Joint (A location between IP and LP turbine)

As shown in the Table above in the steady state condition, the 5 psi (or appropriate) pressure difference can be achieved by selecting a pre-calculated location of the control-line (3,4) connections to the HP exhaust 16 which is a cold reheat line, i.e. x psi pressure difference can be naturally obtained initially without controlling the valves, but by using the natural pressure drop in the reheat line itself (61 in FIG. 2). However, active control can be used for conditions where additional thrust is needed as indicated in Table 1 above.

Note that $P_A$, $P_B$ and $P_C$ pressures can be individually adjusted to a lower pressure than a source pressure by adjusting the amount of opening of the control valves. This enables a closer control of pressure at control locations than just shifting valve position simply from closed to fully open. By this feature, thrust force can be adjusted smoothly. This is still valid even when the upstream pressure (pressure on the right hand side of the thrust piston 15) varies.

As indicated in Table 1, if a steam turbine operates at its normal design condition, the control pressure (valve opening) can be optimized to best fit the operating condition, i.e. to minimize cooling steam needed in the system.

Thus, the advantages of the present actively controlled protective pressure barrier and flexible thrust control include but are not limited to: enhancing turbine reliability by actively protecting bearings such as thrust bearings which may oil seals from failing or being damaged by high temperature steam in a steam turbine; maximizing machine efficiency by actively controlling the amount of cooling steam and the amount of steam dump for steam sealing in other locations in a steam turbine; and controlling thrust in the case of a design flaw, and thus providing an option for extra thrust as needed depending on operating conditions in a steam turbine.

Additionally, the present positive pressure-barrier and thrust control method may solve a number of additional problems. For example, presently, no safety device exists to protect a bearing, for example a thrust bearing, from high temperature steam in case of an N-packing failure in a steam turbine. The present positive pressure barrier method will prevent high temperature steam from the high-pressure casing of the steam turbine from reaching the bearing area regardless of a packing rub-off condition. This improves thrust bearing reliability by preventing potential thermal failure, and therefore improves machine reliability, life-span, and service intervals.

Figure 3:
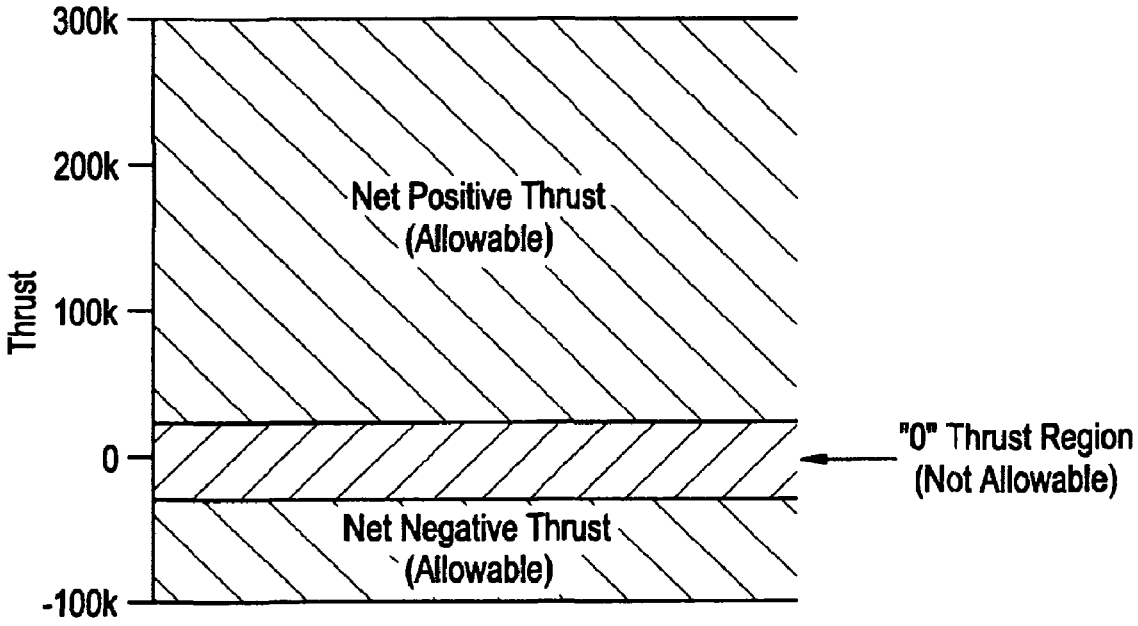
FIG. 3 is a graph showing a zero thrust region of a thrust bearing.

Additionally, uncertainties in thrust design, both in direction and load, can be significant. Having variable pressure sources located over a wide range reduces these risks. Thus the present invention will avoid the risk of a zero or reverse thrust situation as shown in FIG. 3, and will compensate for the thrust as needed in case the thrust bearing is undersized. Thus, there is also no need to machine additional thrust steps in a rotor of the thrust piston, therefore simplifying the thrust piston mechanism.

Presently, in the art, there is no means to control leak-off steam and cooling steam once the packing seal design is implemented. Some of the leak-off steam is sent to a steam-seal-header, which controls a steam seal packing flow. However, any steam dump, is dumped and not recuperated for power generation unless additional piping is established. Therefore, the present invention may allow for means to actively control the amount of dumped steam, which can be referred as active self-sealing point control.

Additional benefits in turbine design include the fact that the cooling flow is recirculated back to a cold reheat and reused in the reheater, therefore forming a closed flow loop instead of just forming a skimmed-off flow loop. This results in energy savings especially when there is massive rub-offs in N-packings.

A mode of operation for the positive pressure barrier can be chosen out of multiple possible sets of valve settings. By using a pressure control valve combined with pressure/flow control valve, a significant amount of cooling flow can be saved allowing only a minimum required steam flow in the packings to maintain a steam seal system. This is important because the amount of extracted cooling flow has non-negligible impact on turbine Heat Rate.

As a result of the present system use of a pressure control valve can eliminate and substitute many previously required seal teeth. Therefore, brush seals if planned can be placed where a HiLo tooth pitch is large, or equivalently, rotor length can be reduced for the benefit of rotor dynamics.

Additionally, the flexibility provided by being able to choose a different pressure source also eliminates problems associated with differential thermal expansion at an IP-HP vertical joint (VJ) during the startup. Depending on the need, the controller can choose to dump leak-off steam into the IP section 12 as needed until the turbine shell fully heats up.

Thus, for the reasons discussed above and other reasons the present invention provides many advantages over the art.

While the invention is described with reference to an exemplary embodiment, it will be understood by those skilled in the art that various changes may be made and equivalence may be substituted for elements thereof without departing from the scope of the invention. In addition, many modifications may be made to the teachings of the invention to adapt to a particular situation without departing from the scope thereof. Therefore, it is intended that the invention not be limited to the embodiment disclosed for carrying out this invention, but that the invention includes all embodiments falling with the scope of the intended claims. Moreover, the use of the term's first, second, etc. does not denote any order of importance, but rather the term's first, second, etc. are used to distinguish one element from another.

What is claimed is:

1. A method for actively controlling thrust pressure in a steam turbine comprising:

monitoring a thrust pressure affecting a thrust fitting in a steam turbine; and adjusting the thrust pressure to maintain a desired thrust pressure on the thrust fitting in the steam turbine;

wherein the adjusting comprises:

adjusting a first pressure tap connected to an input control line in order to adjust the thrust pressure to maintain the desired thrust pressure on the thrust fitting wherein the input control line sends steam from a cold reheat line to the first pressure tap.

2. The method of claim 1 wherein the adjusting further comprises:

adjusting a second pressure tap wherein the second pressure tap is connected to an output control line which returns the steam to the cold reheat line and wherein the second pressure tap is also connected to a third control line located proximate to the thrust fitting which sends cooling steam from a high pressure casing to a lower pressure casing and which includes a third pressure tap.

3. The method of claim 2 wherein the adjusting is performed to create about 5 psi less thrust pressure at the second pressure tap than at the first pressure tap.

4. The method of claim 1 wherein the adjusting provides and maintains a stable thrust pressure during steady state operation.

5. The method of claim 1 wherein the adjusting provides and maintains a stable thrust pressure during start-up of the steam turbine.

6. The method of claim 1 wherein the adjusting provides and maintains a stable thrust pressure during anomalous operating conditions of the steam turbine.

7. The method of claim 1 wherein the adjusting provides and maintains a stable thrust pressure during a packing rub off operating condition of the steam turbine and wherein a thrust pressure barrier is formed that prevents high temperature steam from a high-pressure casing of the steam turbine from reaching the thrust fitting area despite the packing rub-off condition thereby preventing thermal failure and increasing reliability, life-span or service intervals.

8. The method of claim 1 wherein the thrust fitting is a thrust bearing.

9. The method of claim 1 wherein the thrust fitting is a thrust piston.

10. The method of claim 1 further comprising:

actively controlling an amount of cooling steam and a steam dump for steam sealing in the steam turbine.

11. A control apparatus for actively controlling the thrust on a thrust fitting in a steam turbine comprising:

an input control line for diverting cold reheat steam from a cold reheat line of a first stage of a steam turbine to a thrust fitting area;

a first pressure tap connected to the input control line;

an output control line for returning the cold reheat steam from the thrust fitting area to the cold reheat line;

a third control line located between the first pressure stage and at least one additional pressure stage;

a third pressure tap connected to the third control line;

a second pressure tap connected to the output control line and connected to the third control line;

a plurality of pressure sensors located in the lines; and a controller wherein the controller is structured to receive pressure data from the sensors and to actively control the pressure taps to regulate thrust pressure in a thrust fitting area.

12. A method for actively controlling thrust pressure in a steam turbine comprising:

monitoring a thrust pressure affecting a thrust fitting in a steam turbine; and adjusting the thrust pressure to maintain a desired thrust pressure on the thrust fitting in the steam turbine;

wherein the adjusting provides and maintains a stable thrust pressure during start-up of the steam turbine.

13. A method for actively controlling thrust pressure in a steam turbine comprising:

monitoring a thrust pressure affecting a thrust fitting in a steam turbine; and adjusting the thrust pressure to maintain a desired thrust pressure on the thrust fitting in the steam turbine;

actively controlling an amount of cooling steam and a steam dump for steam sealing in the steam turbine.

14. The method of claim 13 wherein the adjusting provides and maintains a stable thrust pressure during steady state operation.

15. The method of claim 13 wherein the adjusting provides and maintains a stable thrust pressure during start-up of the steam turbine.

16. The method of claim 13 wherein the adjusting provides and maintains a stable thrust pressure during anomalous operating conditions of the steam turbine.

* * * * *